US006815060B2

(12) United States Patent
Yuuki

(10) Patent No.: US 6,815,060 B2
(45) Date of Patent: Nov. 9, 2004

(54) SPUN YARN

(75) Inventor: Yasunori Yuuki, Kawanishi (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/398,473

(22) PCT Filed: Oct. 5, 2001

(86) PCT No.: PCT/JP01/08835

§ 371 (c)(1),
(2), (4) Date: Apr. 4, 2003

(87) PCT Pub. No.: WO02/31241

PCT Pub. Date: Apr. 18, 2002

(65) Prior Publication Data

US 2004/0011017 A1 Jan. 22, 2004

(30) Foreign Application Priority Data

Oct. 6, 2000 (JP) ..... 2000-308316
Apr. 26, 2001 (JP) ..... 2001-129915

(51) Int. Cl.[7] ..... D01F 6/00
(52) U.S. Cl. ..... 428/364; 428/359; 428/395
(58) Field of Search ..... 428/364, 359, 428/395; 524/497

(56) References Cited

U.S. PATENT DOCUMENTS 3,681,188 A 8/1972 Harris
6,071,612 A 6/2000 Roderiguez et al. ..... 428/364
6,306,498 B1 * 10/2001 Yuuki et al. ..... 428/359
6,440,555 B1 * 8/2002 Yuuki et al. ..... 428/364
6,673,444 B2 * 1/2004 Yuuki et al. ..... 428/364
6,680,353 B1 * 1/2004 Kato et al. ..... 524/497

FOREIGN PATENT DOCUMENTS

| | | |
|---|---|---|
| EP | 1 209 262 A1 | 5/2002 |
| JP | 49-21256 | 2/1974 |
| JP | 11-93033 | 4/1999 |
| JP | 11-189938 | 7/1999 |
| JP | 11-269731 | 10/1999 |
| JP | 11-269777 | 10/1999 |
| JP | 2000-154457 | 6/2000 |
| WO | WO 02/22925 A1 | 3/2002 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

A spun yarn comprising poly(trimethylene terephthalate) staple fibers at a content of at least 15% by weight, the spun yarn having an elastic recovery percentage of elongation at 5% elongation (%) ≧0.1 X+70 (wherein X represents the content of poly(trimethylene terephthalate) staple fibers in the spun yarn (wt %)). The spun yarn is excellent in knitting and weaving characteristics, stretchability and stretch-back property and in shape stability and durability when worn for a prolonged period of time.

6 Claims, No Drawings

SPUN YARN

TECHNICAL FIELD

The present invention relates to a spun yarn comprising poly(trimethylene terephthalate) staple fibers.

BACKGROUND ART

Spun yarns produced from natural fibers such as cotton, wool and linen (ramie) as raw materials have excellent feelings peculiar to the respective fibers, so that they find wide applications. However, spun yarns produced totally from such natural fibers have drawbacks in handling characteristics and in durability when worn, such as relatively low strength, large shrinkage after washing and large configurational change.

Therefore, in order to cope with such drawbacks, wide use is made of blended spun yarns produced by blend spinning (mix spinning) natural fibers and staples (discontinuous fibers or short fibers) of synthetic fibers. A representative example of the synthetic fibers used in the blend spinning is a poly(ethylene terephthalate) fiber. The blend spinning thereof exerts apparent effects on improvements in strength and in shape stability. However, the poly(ethylene terephthalate) fiber has large Young's modulus, so that its feel is hard. Thus, the poly(ethylene terephthalate) fiber has a fatal drawback in that when blend-spun with natural fibers, the excellent feel of natural fibers would inevitably be deteriorated even if the blending ratio thereof is low.

Recently, appropriate stretchability and stretch-back property are increasingly demanded on woven fabrics and knit fabrics for clothing. CSY (core spun yarn) having a core constituted of an elastic yarn, such as spandex, is well known as a spun yarn with stretchability and stretch-back property. However, spandex poses such a problem that embrittlement by chemicals, such as chlorine, is serious and colorfastness thereof is low. Further, CSY has drawbacks in that breakage of spandex constituting a core yarn (namely, core breakage) is likely to occur during the manufacturing or aftertreatment, and that accurate insertion of spandex in the core is technically difficult. Yarn having spandex protruding outside inflicts a loss in manufacturing, thereby lowering the yield and increasing the manufacturing cost. Because of these problems, there is a demand on a spun yarn with excellent stretchability produced without the use of spandex.

On the other hand, poly(trimethylene terephthalate) fibers are publicly known as fibers of low initial stretching resistance (Young's modulus) and high elastic recovery. Japanese Patent Publication No. 49(1974)-21256 discloses a crimped fiber with a flexure recovery of at least 70% wherein a poly(butylene terephthalate) fiber and a poly(trimethylene terephthalate) fiber are contained in a proportion of 50 wt % or more, and further discloses a staple fiber obtained by cutting the crimped fiber into given lengths. Japanese Patent Laid-Open No. 11(1999)-189938 discloses a staple fiber of poly(trimethylene terephthalate) having its elastic recovery percentage of elongation and flexure recovery enhanced by thermal treatment.

In both of these published inventions, there is no particular disclosure at all with respect to the most suitable spun yarn specifications and characteristics regarding the spun yarn produced from the above staple fibers, although the elastic recovery percentage of elongation and flexure recovery of poly(trimethylene terephthalate) filament and staple fibers are disclosed.

DISCLOSURE OF THE INVENTION

It is an object of the present invention to provide a poly(trimethylene terephthalate) spun yarn which is excellent in knitting and weaving characteristics and excellent in at least one of stretchability, stretch-back property, shape stability and durability when worn for a prolonged period of time, etc., and by which a woven fabric and knit fabric making the most of the feeling of other material blended with poly(trimethylene terephthalate) staple fibers can be obtained.

The inventors have made extensive and intensive investigations with a view toward attaining the above object. As a result, it has been found that the above object can be attained by the use of a spun yarn with specified properties comprising poly(trimethylene terephthalate) staple fibers. The present invention has been completed on the basis of this finding.

That is, the present invention is as follows.

1. A spun yarn comprising poly(trimethylene terephthalate) staple fibers (discontinuous fibers or short fibers) at a content of at least 15% by weight, the spun yarn having an elastic recovery percentage of elongation at 5% elongation satisfying the formula:

$$\text{elastic recovery percentage of elongation at 5\% elongation } (\%) \geqq 0.1X+70 \quad \text{(a)}$$

wherein X represents the content of poly(trimethylene terephthalate) staple fibers in the spun yarn (% by weight).

2. The spun yarn according to item 1 above, which is a composite spun yarn comprising poly(trimethylene terephthalate) staple fibers and other fibers, wherein the content of poly(trimethylene terephthalate) staple fibers is in the range of 15 to 70% by weight.

3. The spun yarn according to item 1 or 2 above, which exhibits an elongation at break (rupture) of 10% or greater.

4. The spun yarn according to item 1, 2 or 3 above, which exhibits a tenacity (tensile strength) and elongation product of 15 cN·%/dtex or greater.

5. The spun yarn according to any of items 1 to 4 above, which exhibits an I-coefficient or L-coefficient of 1.0 to 2.5.

6. The spun yarn according to any of items 1 to 5 above, to which a finishing oil has been applied, the finishing oil containing an alkyl phosphate salt whose alkyl group has 8 to 18 carbon atoms on the average.

In the present invention, the elastic recovery percentage of elongation at 5% elongation (%), elongation at break (%), tenacity and elongation product (cN.%/dtex), initial stretching resistance (cN/dtex), I-coefficient and L-coefficient were measured in the following manner.

(1) Elastic Recovery Percentage of Elongation at 5% Elongation

Initial load specified in JIS-L-1095 (method of testing a common spun yarn) was applied to each spun yarn, and the length thereof was extended to given elongation L (5%=1 cm) with the use of constant-rate extension type tensile tester in accordance with the method of measuring an elastic recovery percentage of elongation (method A) under such conditions that the chuck spacing was 20 cm and that the stretch speed was 50% of the chuck spacing per minute. The spun yarn was allowed to stand still for 1 min, and the original length thereof was restored at the same speed. The spun yarn was allowed to stand still for 3 min, and again the length thereof was extended to point $L_1$ at which the initial load was applied at the same speed. The elastic recovery percentage of elongation Ec (%) was calculated by the formula:

$$Ec(\%)=\{(L-L_1)/L\}\times 100$$

The test was performed 5 times, and the measurements were averaged.

(2) Elongation at Break, Tenacity and Elongation Product and Initial Stretching Resistance Initial load specified in JIS-L-1095 (method of testing a common spun yarn) was applied to each spun yarn, and a tensile test thereof was performed with the use of constant-rate extension type tensile tester under such conditions that the chuck spacing was 30 cm and that the stretch speed was 100% of the chuck spacing per minute. Thus, the tenacity at break (cN/dtex) and elongation at break (%) (ratio of extent of elongation at break to chuck spacing) were determined.

the tenacity and elongation product was calculated by the formula:

Tenacity and elongation product (cN·%/dtex)=tenacity at break (cN/dtex)×elongation at break (%)

The initial stretching resistance (cN/dtex) was determined by, on a drawn load—elongation curve, identifying a point of maximum load change vs. elongation change at a proximity to the original point and by measuring the gradient of a tangential line at the identified point.

The test was performed 20 times, and the measurements were averaged.

(3) I-Coefficient and L-Coefficient

The I-coefficient and L-coefficient are coefficients expressing the uniformity of yarn, and are also referred to as unevenness indexes.

The I-coefficient and L-coefficient are values obtained by measuring U % (average deviation percentage of weight of yarn per unit length thereof) by means of a USTER.TESTER-3 manufactured by Zellweger Uster K. K. and dividing the measurement by theoretical limit uniformity $U_{lim}$, and calculated by the following formulae depending on the magnitude of the number of constituent staple fibers.

(1) When the Number of Constituent Staple Fibers is 64 or Less, $$I\text{-coefficient}=U\%\times(\text{number of constituent staple fibers})^{1/2}/80 \quad (b)$$

(2) When the number of constituent staple fibers exceeds 64, $$L\text{-coefficient}=U\%\times(\text{number of constituent staple fibers})^{1/3}/40 \quad (c)$$

Herein, the number of constituent staple fibers refers to the average number of staple fibers lying in a section of spun yarn, and calculated by the formula:

Number of constituent staple fibers=fineness of spun yarn (dtex)/average fineness of staple fiber (dtex).

When staple fibers of different fineness values are blend-spun, for example, when blend spinning is performed with the use of staple fibers of fineness $D_1$ (dtex) at a blending ratio of $W_1$ (%) and staple fibers of fineness $D_2$ (dtex) at a blending ratio of $W_2$ (%), the number of constituent staple fibers is calculated by the formula:

Number of constituent staple fibers=fineness of spun yarn (dtex)×$(W_1/100)/D_1$+fineness of spun yarn (dtex)×$(W_2/100)/D_2$ The present invention will be described in detail below.

The spun yarn of the present invention contains poly (trimethylene terephthalate) staple fibers in an amount of at least 15 wt %. That is, the spun yarn of the present invention may be a spun yarn consisting 100 wt % of poly (trimethylene terephthalate) staple fibers, and also may be a composite spun yarn produced by blend spinning of poly (trimethylene terephthalate) staple fibers and at least one other staple fibers, wherein poly(trimethylene terephthalate) staple fibers are contained in an amount of 15 wt % or more. The incorporation of poly(trimethylene terephthalate) staple fibers in an amount of 15 wt % or more enables obtaining a spun yarn which exhibits a high elastic recovery percentage of elongation and which is excellent in stretchability, stretch-back property and shape stability upon long-term wearing.

The spun yarn of the present invention, when consisting totally of poly(trimethylene terephthalate) staple fibers, exhibits the highest stretchability and stretch-back property. However, on the other hand, the poly(trimethylene terephthalate) staple fibers, when formed into a composite spun yarn with other fibers, can exhibit further excellent characteristics. That is, composite spinning of poly (trimethylene terephthalate) staple fibers with other fibers enables obtaining a spun yarn which while satisfactorily making the most of the feeling of blended other fibers, exerts excellent functions with respect to stretchability, stretch-back property, shape stability, etc.

In the composite spun yarn, the content of poly (trimethylene terephthalate) staple fibers is preferably in the range of 15 to 70 wt %. For more effectively utilizing the feeling of other fibers, the content is still preferably in the range of 20 to 40 wt %. When the content of poly (trimethylene terephthalate) staple fibers is 15 wt % or greater, there can be obtained a spun yarn which has an elastic recovery percentage of elongation at 5% elongation satisfying the above formula (a) and exhibits a satisfactory stretch-back property. Further, when the content of poly (trimethylene terephthalate) staple fibers is 70 wt % or less, there can be obtained a spun yarn which can satisfactorily make the most of the feeling of blended other fibers.

The other fibers to be blend-spun with the poly (trimethylene terephthalate) staple fibers are not particularly limited, and can be selected in conformity with the properties demanded for desired commodity. The blend-spun other fibers may be, for example, any of natural fibers such as cotton, linen (ramie), wool and silk; chemical fibers such as cupra, viscose, polynosic, purified cellulose and acetate fibers; polyester fibers such as poly(ethylene terephthalate) and poly(butylene terephthalate) fibers; synthetic fibers such as acrylic and polyamide fibers; copolymer type fibers derived from these; and conjugate fibers from identical polymer or different types of polymers (side-by-side type, eccentric sheath core type, etc.).

The method of blending fibers for obtaining a composite spun yarn is not particularly limited. For example, use can be made of the method wherein raw staple fibers are blended with poly(trimethylene terephthalate) staple fibers in a blowing and scutching step or a carding step, the method wherein slivers are piled one upon another into a composite form in a drawing step or a mixing gill step, or the method wherein, in a spinning step, a plurality of slivers or roving yarns are supplied and a spinning (CSIROSPUN system) is carried out thereon.

More specifically, for example, a composite spun yarn composed of cotton and poly(trimethylene terephthalate) staple fibers is preferably produced by, in a spinning process according to cotton spinning system, passing staple fibers consisting 100 wt % of poly(trimethylene terephthalate) staple fibers (preferably a fiber length of 38 mm) through a carding machine to form a sliver and, in a subsequent drawing step, doubling the formed sliver with a cotton sliver into a composite form. On the other hand, a composite spun yarn composed of wool or linen (ramie) and poly (trimethylene terephthalate) staple fibers is preferably produced by, in a spinning process according to worsted spinning system, passing staple fibers consisting 100 wt % of poly(trimethylene terephthalate) staple fibers (bias cut into fiber lengths of 64 mm or greater) through a roller carding machine to form a sliver and thereafter doubling the formed sliver with a wool or linen (ramie) sliver into a composite form by means of a mixer (mixing gill or bobbiner equipped with porcupine roller). Further, when it is intended to produce a composite spun yarn composed of cashmere or lamb's wool and poly(trimethylene terephthalate) staple fibers by a spinning process according to woolen spinning system, the application to roller carding machine is preferably performed after the mixing at raw staple fiber preparation.

The spun yarn of the present invention has an elastic recovery percentage of elongation at 5% elongation satisfying the above formula (a). The elastic recovery percentage of elongation at 5% elongation of the spun yarn of the present invention is preferably in the range of 75 to 100%, still more preferably, 80 to 100%.

When the elastic recovery percentage of elongation at 5% elongation satisfies the above formula (a), satisfactory stretch-back property can be realized. The knit fabric or woven fabric from the spun yarn is excellent in fitness as a clothing. Further, deforming and dimensional change thereof are slight irrespective of long-term wearing or repeated washings. That is, the knit fabric or woven fabric from the spun yarn is excellent in shape stability.

In this connection, the spun yarn from poly(ethylene terephthalate) staple fibers or poly(butylene terephthalate) staple fibers in place of the poly(trimethylene terephthalate) staple fibers cannot satisfy the above formula (a).

The elongation at break of the spun yarn of the present invention is preferably 10% or greater, still preferably in the range of 20 to 60%. When the elongation at break falls within this range, the occurrence of yarn breakage at knitting or weaving is less, thereby realizing satisfactory knitting and weaving characteristics and enabling obtaining a woven fabric of excellent stretchability.

The tenacity and elongation product of the spun yarn of the present invention is preferably 15 cN.%/dtex or greater, still preferably in the range of 20 to 100 cN.%/dtex. When the tenacity and elongation product is 15 cN.%/dtex or greater, the yarn exhibits high toughness. Thus, such effects as an increase of resistance to rupture under instantaneous high stress and a decrease of tenacity and elongation deterioration under repeated stress can be exerted. Consequently, a woven fabric of high impact resistance and durability, which is most suitable for sports clothing and the like, can be obtained.

The spun yarn of the present invention exhibits an I-coefficient or L-coefficient as an index expressing the uniformity thereof which preferably falls within the range of 1.0 to 2.5, still preferably 1.0 to 2.0. When the I-coefficient or L-coefficient falls within the above range, there can be obtained a spun yarn of reduced unevenness and high uniformity. Thus, woven and knit fabrics of high quality can be obtained.

The uniformity of spun yarn is generally expressed by U % measured with the use of Uster unevenness tester. However, the U % is largely varied depending on the size (fineness) of spun yarn and the size (fineness) of staple fibers constituting the spun yarn. Therefore, from the viewpoint of reducing the effect of the fineness of spun yarn and staple fibers, it is preferred that the uniformity be expressed by the I-coefficient or L-coefficient which is a ratio to the theoretical limit uniformity $U_{lim}$. These coefficients are respectively calculated by the above formulas (b) and (c), depending on the magnitude of the average number of staple fibers constituting the spun yarn, namely, the number of constituent staple fibers.

It is preferred that the twist of the spun yarn of the present invention be appropriately set in conformity with the fiber length so that the twist multiplier $\alpha$ ($\alpha$=twist (T/m)/(metric count$^{0.3}$)) in terms of metric count falls within the range of 60 to 120. The stretchability of the spun yarn can be increased by setting the twist for a level as low as possible within the range that the strength of the spun yarn can be satisfactorily attained.

It is generally preferred that the single-fiber fineness of the spun yarn of the present invention be in the range of 0.1 to 10.0 dtex. When the spun yarn is used for clothing purposes, the single-fiber fineness is still preferably in the range of 1.0 to 6.0 dtex.

The fiber length of the staple fibers is preferably in the range of about 30 to about 160 mm, and can be selected taking into account the usage, the spinning method, the fiber length of blended other material, etc. From the viewpoint of attaining desirable spinnability and obtaining a spun yarn of high quality, it is preferred that the weight percentage of staple fibers over the limited cut length (content of single fibers having lengths greater than the set fiber length) be 0.5 wt % or less.

The initial stretching resistance of the poly(trimethylene terephthalate) staple fibers for use in the spun yarn of the present invention is preferably in the range of 10 to 30 cN/dtex, still preferably 20 to 30 cN/dtex, and further still preferably 20 to 27 cN/dtex. In this connection, producing poly(trimethylene terephthalate) staple fibers whose initial stretching resistance is less than 10 cN/dtex is difficult.

With respect to the poly(trimethylene terephthalate) staple fibers for use in the present invention, the cross section of each single fiber may be uniform or the size may vary in the longitudinal direction thereof. The morphology of the cross section may be circular, triangular, L-shaped, T-shaped, Y-shaped, W-shaped, eight leaves shaped, flat shaped (degree of flatness in a range from about 1.3 to 4, including, for example, W-shape, I-shape, boomerang shape, corrugation, skewered dumpling shape, cocoon shape and rectangular parallelopipedon), polygonal (for example, dog bone shape), multileaf-shaped, hollow or undefinable.

In the present invention, the poly(trimethylene terephthalate) refers to a polyester comprising trimethylene terephthalate units as main repeating units, wherein the content of trimethylene terephthalate units is preferably 50 mol % or more, more preferably 70 mol % or more, further more preferably 80 mol % or more, and optimally 90 mol % or more. Thus, the poly(trimethylene terephthalate) comprehends a poly(trimethylene terephthalate) containing other acid component and/or glycol component as a third component in a total amount of preferably about 50 mol % or less, still preferably 30 mol % or less, further still preferably 20 mol % or less, and optimally 10 mol % or less.

The poly(trimethylene terephthalate) is synthesized by polycondensation of terephthalic acid or a functional derivative of terephthalic acid, such as dimethyl terephthalate, and trimethylene glycol or a functional derivative thereof in the presence of a catalyst under appropriate reaction conditions. In this synthetic process, copolymerization may be carried out by adding, as appropriate, one or two or more third components. Also, the poly(trimethylene terephthalate) may be blended with a polyester other than poly(trimethylene terephthalate), such as poly(ethylene terephthalate), nylon or the like.

As the third component which can be added, there can be mentioned, for example, an aliphatic dicarboxylic acid (e.g., oxalic acid or adipic acid), an alicyclic dicarboxylic acid (e.g., cyclohexanedicarboxylic acid), an aromatic dicarboxylic acid (e.g., isophthalic acid or sodium sulfoisophthalate), an aliphatic glycol (e.g., ethylene glycol, 1,2-propylene glycol or tetramethylene glycol), an alicyclic glycol (e.g., cyclohexanedimethanol), an aliphatic glycol containing aromatic group (e.g., 1,4-bis(β-hydroxyethoxy) benzene), a polyether glycol (e.g., polyethylene glycol or polypropylene glycol), an aliphatic oxycarboxylic acid (e.g., ω-oxycaproic acid), or an aromatic oxycarboxylic acid (e.g., p-oxybenzoic acid). Furthermore, a compound having one, or three or more ester forming functional groups (benzoic acid or the like, or glycerol or the like) can be used as the third component as far as the obtained polymer is substantially linear.

The poly(trimethylene terephthalate) staple fibers may contain modifiers, for example, a delustering agent such as titanium dioxide, a stabilizer such as phosphoric acid, an ultraviolet absorber such as a hydroxybenzophenone derivative, a crystallization nucleating agent such as talc, a lubricant such as aerosil, an antioxidant such as a hindered phenol derivative, a flame retardant, an antistatic agent, an antistatic additive, a delustering additive, a pigment, a fluorescent brightener, an infrared absorber and an antifoaming agent.

In the present invention, the poly(trimethylene terephthalate) staple fibers are not limited to staple fibers of one type of poly(trimethylene terephthalate), and may include staple fibers of two or more types of poly (trimethylene terephthalate) polymers which are different from each other in the degree of polymerization, copolymer composition, etc. and staple fibers whose at least one component is poly(trimethylene terephthalate), which staple fibers further contain other components. For example, latent crimp polyester staple fibers can be mentioned as preferable staple fibers.

The latent crimp polyester staple fibers refer to staple fibers composed of at least two types of polyester components (for example, often joined into a side-by-side type or an eccentric sheath core type), which staple fibers develop crimp when subjected to thermal treatment. With respect to the two types of polyester components, the combining ratio (generally often ranging from 70/30 to 30/70 (weight ratio)) and a cross sectional configuration in joining interface of a single filament (occasionally linear or curved configuration) are not particularly limited. The single-fiber fineness thereof is preferably in the range of 0.5 to 10 dtex, which range is however not limitative.

The latent crimp polyester staple fibers are satisfactory as long as at least one component thereof is poly(trimethylene terephthalate).

For example, there can be mentioned those whose at least one component is poly(trimethylene terephthalate) as disclosed in Japanese Patent Laid-Open No. 2001-40537. Specifically, the disclosed staple fibers consist of a conjugate fiber comprising two types of polyester polymers joined to each other in side-by-side form or in the form of an eccentric sheath core. In the conjugate fiber of side-by-side type, the melt viscosity ratio of the two types of polyester polymers is preferably in the range of 1.00 to 2.00. In the conjugate fiber of eccentric sheath core type, it is preferred that with respect to the ratio of alkali weight reduction velocity between sheath polymer and core polymer, the velocity of the sheath polymer be 3 times or more greater than that of the core polymer.

With respect to particular polymer combinations, a combination of poly(trimethylene terephthalate) and poly (ethylene terephthalate) and a combination of poly (trimethylene terephthalate) and poly(butylene terephthalate) are preferred. Fibers having poly (trimethylene terephthalate) arranged inside the crimp are especially preferred.

In the present invention, the latent crimp polyester staple fibers may be those wherein at least one of the polyester components constituting the staple fibers is poly (trimethylene terephthalate), for example, those wherein the first component consists of poly(trimethylene terephthalate) while the second component consists of a polymer selected from among polyesters, such as poly(trimethylene terephthalate), poly(ethylene terephthalate) and poly (butylene terephthalate), and nylons, the first component and the second component arranged in parallel or eccentric relationship into a conjugate spun fiber of side-by-side type or eccentric sheath core type. In particular, a combination of poly(trimethylene terephthalate) and copolymerized poly (trimethylene terephthalate) and a combination of two poly (trimethylene terephthalate) polymers having different intrinsic viscosity values are preferred.

Examples of these latent crimp polyester staple fibers are disclosed in not only the above Japanese Patent Laid-Open No. 2001-40537 but also, for example, Japanese Patent Publication No. 43(1968)-19108, Japanese Patent Laid-Open No. 11(1999)-189923, Japanese Patent Laid-Open No. 2000-239927, Japanese Patent Laid-Open No. 2000-256918, Japanese Patent Laid-Open No. 2000-328382 and Japanese Patent Laid-Open No. 2001-81640.

The difference of intrinsic viscosity between two types of poly(trimethylene terephthalate) polymers is preferably in the range of 0.05 to 0.4 dl/g, still preferably 0.1 to 0.35 dl/g and further still preferably 0.15 to 0.35 dl/g. For example, when the intrinsic viscosity of high-viscosity side is selected within the range of 0.7 to 1.3 dl/g, it is preferred that the intrinsic viscosity of low-viscosity side be selected within the range of 0.5 to 1.1 dl/g. In this connection, the intrinsic viscosity of low-viscosity side is preferably 0.8 dl/g or greater, still preferably in the range of 0.85 to 1.0 dl/g, and further still preferably 0.9 to 1.0 dl/g.

The average intrinsic viscosity of the above conjugate fiber is preferably in the range of 0.7 to 1.2 dl/g, still preferably 0.8 to 1.2 dl/g, further still preferably 0.85 to 1.15 dl/g, and optimally 0.9 to 1.1 dl/g.

The value of intrinsic viscosity expressed in the present invention refers not to the viscosity of employed polymer but to the viscosity of the spun yarn. The reason is that the poly(trimethylene terephthalate) is likely to suffer thermal decomposition as compared with poly(ethylene terephthalate) or the like, so that even if a polymer of high intrinsic viscosity is used, the intrinsic viscosity would be lowered by thermal decomposition during the spinning step with the result that with respect to the obtained conjugate fiber, it would be difficult to maintain the intrinsic viscosity difference between raw polymers as it was.

The poly(trimethylene terephthalate) staple fibers for use in the present invention can be obtained by, for example, the following process.

First, filaments are obtained by, for example, the method wherein poly(trimethylene terephthalate) having an intrinsic viscosity of 0.4 to 1.9, preferably 0.7 to 1.2, is melt spun and taken up at a speed of about 1500 m/min to thereby obtain an undrawn filament, the undrawn filament subjected to drawing at a ratio of about 2 to 3.5; the direct drawing method (spin drawing method) wherein the spinning and drawing steps are directly connected; or the high-speed spinning method (spin take-up method) wherein the take-up speed is 5000 m/min or higher.

Obtained filaments are continuously formed into a tow. Alternatively, obtained filaments are temporarily wound up into a package, and thereafter unwound and formed into a tow. Finishing oil for spinning is applied to the tow, and thermal treatment thereof is performed according to necessity. The resultant tow is crimped by appropriate crimping operation, and cut into given lengths, thereby obtaining desired staple fibers.

When filaments temporarily wound into a package are unwound and formed into a tow, it is preferred to apply the finishing oil for spinning after removing a finishing oil for filaments having previously been applied to the filaments. Although drawing can be performed after formation of melt spun undrawn filament into a tow, from the viewpoint of obtaining uniform staple fibers, it is preferred that tow formation be carried out after drawing.

Use can also made of partially oriented undrawn filaments obtained by, in the melt spinning, winding at a take-up speed of preferably 2000 m/min or greater, still preferably 2500 to 4000 m/min. In that instance, it is preferred that crimping operation be performed after drawing at natural draw ratio or a lower ratio.

Alternatively, without cutting into staple fibers in advance, the tow may be supplied in the spinning process, cut into staple fibers with the use of a tow stretch breaking machine and formed into a spun yarn.

Although the poly(trimethylene terephthalate) fiber has such a peculiar problem that the interfibrous frictional force thereof is high as compared with that of poly(ethylene terephthalate) fiber or the like, satisfactory spinning characteristics and formation of a spun yarn of high uniformity can be accomplished by applying an appropriate finishing oil for spinning in an appropriate amount.

In the present invention, the main purpose of the finishing oil applied to the poly(trimethylene terephthalate) staple fibers is to not only impart antistatic property but also lower the interfibrous frictional force so as to enhance the openability of the tow. Further, the main purpose of the finishing oil on the other hand is to impart an appropriate convergence property to the tow and moreover lower the fiber vs. metal frictional force to thereby prevent damaging of fibers in the opening step. The finishing oil preferably consists of an anionic surfactant often used as an antistatic agent. For example, a finishing oil whose main component is an alkyl phosphate salt whose alkyl group has 8 to 18 carbon atoms on the average is preferred. A finishing oil whose main component is an alkyl phosphate potassium salt whose alkyl group has 8 to 18 carbon atoms on the average is still preferred. A finishing oil whose main component is an alkyl phosphate potassium salt whose alkyl group has 10 to 15 carbon atoms on the average is especially preferred.

The alkyl phosphate salt can be, for example, any of lauryl phosphate potassium salt (average number of carbon atoms: 12), cetyl phosphate potassium salt (average number of carbon atoms: 16) and stearyl phosphate potassium salt (average number of carbon atoms: 18). However, the alkyl phosphate salt for use in the present invention is not limited to these. The content of alkyl phosphate salt in finishing oil components is preferably in the range of 50 to 100 wt %, still preferably 70 to 90 wt %.

In order to enhance the smoothness of fiber and to prevent damaging of fibers, the finishing oil may contain an animal or vegetable oil, a mineral oil, a fatty acid ester compound, or a nonionic activator consisting of, for example, an oxyethylene or oxypropylene compound of a fatty acid ester of aliphatic higher alcohol or polyhydric alcohol as another finishing oil component in an amount of 50 wt % or less, preferably 10 to 30 wt %.

The amount of adhering finishing oil for spinning is preferably in the range of 0.05 to 0.5% omf, still preferably 0.1 to 0.35% omf, and further still preferably 0.1 to 0.2% omf.

When the selection of finishing oil is appropriate and the amount of adhering finishing oil falls within the above range, high spinnability can be attained and a spun yarn of high uniformity can be obtained. When the amount of adhering finishing oil is too much, however, wrap on a cylinder is likely to occur in the carding step. Further, wrap on a top roller (rubber roller) is likely to occur in the roller draft operation of drawing step, roving step, spinning step, etc. On the other hand, when the amount of adhering finishing oil is too small, damaging of staple fibers is likely to occur in the opening step. Further, the generation of static electricity is likely to be too high in the above roller draft operation, thereby causing wrap on a bottom roller (metal roller). The influence of finishing oil is especially conspicuous in the spinning step, and the above wrap of staple fibers on a top roller or bottom roller would invite an increase of end breakage and would deteriorate the uniformity of yarn.

When it is intended to crimp the poly(trimethylene terephthalate) fiber, the method of crimping is not particularly limited. However, from the viewpoint of productivity and excellence of crimp configuration, the stuffer crimping method using a stuffer box is preferred. For ensuring desirable openability of staple fibers and desirable passage through process steps in the spinning process, it is preferred that the number of crimps be in the range of 3 to 30 per 25 mm, especially 5 to 20 per 25 mm, while the degree of crimp be in the range of 2 to 30%, especially 4 to 25%.

It is preferred that the number of crimps and the degree of crimp be increased within the above ranges in accordance with the reduction of fiber length. Specifically, when the fiber length is 38 mm (cotton spinning process), it is preferred that the number of crimps and the degree of crimp be 16±2 per 25 mm and 18±3%, respectively. When the fiber length is 51 mm (synthetic fiber spinning process), it is preferred that the number of crimps and the degree of crimp be 12±2 per 25 mm and 15±3%, respectively. With respect to bias cut fibers of 64 mm or more fiber length (worsted spinning process), it is preferred that the number of crimps and the degree of crimp be 8±2 per 25 mm and 12±3%, respectively. In the woolen process (uniform fiber length of 51 mm), it is preferred that the number of crimps and the degree of crimp be 18±2 per 25 mm and 20±3%, respectively. When the fiber is processed through a carding machine of a high-speed type, the crimp tends to be elongated, so that it is preferred that the degree of crimp be larger by 2 to 5% than the above ranges.

When the number of crimps and the degree of crimp fall within the above ranges, at the carding step, the occurrence of web dangling from a web collecting calender roller or sliver breakage at a coiler calender roller can be avoided, and desirable passage through a carding machine can be ensured. Further, high openability can be attained, so that the occurrence of nep or slub is low. Still further, high spinnability can be attained, so that a spun yarn of high uniformity and of satisfactory I-coefficient or L-coefficient can be obtained.

The process for producing the spun yarn of the present invention is not particularly limited, and common spinning processes, such as the cotton spinning process (fiber length: 32 mm, 38 mm or 44 mm), the synthetic fiber spinning process (fiber length: 51 mm, 64 mm or 76 mm), the worsted spinning process (fiber length: 64 mm or greater, bias cut) and the tow spinning process (tow used), can be employed according to the fiber length of poly(trimethylene terephthalate) staple fibers. Also, the spinning method is not particularly limited, and, for example, the ring spinning method, the rotor type open-end spinning method, the friction type open-end spinning method, the air jet spinning method, the hollow spindle spinning method (lap spinning method) or the self twist spinning method can be employed. Among these, the ring spinning method is preferably employed for obtaining a general-purpose spun yarn making the best of the softness of poly(trimethylene terephthalate) fiber. In the woolen process, it is preferred to employ a mule spinning frame.

As far as the object of the present invention is not departed from, the spun yarn of the present invention may be formed into composite spun yarns with various types of filament yarns, for example, a core spun yarn, a twisted spinning yarn, a lapping yarn and various fancy yarns. According to necessity, the spun yarn may be subjected to doubling (plying or folding) processing or additional twisting processing. Moreover, the spun yarn of the present invention may be formed into a composite yarn with another spun yarn, various filament yarns, a textured yarn or the like by co-twisting, interlacing or fluid jet texturing thereof.

BEST MODE FOR CARRYING OUT THE INVENTION

The present invention will be described in greater detail below with reference to the following Examples and Comparative Examples, which however in no way limit the scope of the present invention.

The employed measuring method and evaluating method were as follows.

(1) Intrinsic Viscosity

The intrinsic viscosity [η] (dl/g) is a value determined by the definition of the following formula:

$$[\eta] = \lim_{c \to 0} (\eta r - 1)/C$$

wherein ηr is a quotient of the viscosity at 35° C. of a dilution of poly(trimethylene terephthalate) yarn or poly(ethylene terephthalate) yarn dissolved in an o-chlorophenol solvent of 98% or higher purity divided by the viscosity, measured at the same temperature, of the above solvent, and is defined as a relative viscosity. C is the concentration of polymer (g/100 ml).

When the staple fiber comprises a conjugate fiber composed of two or more types of polymers having different intrinsic viscosity values, it is difficult to measure the respective intrinsic viscosity values of polymers constituting the conjugate fiber. Therefore, the intrinsic viscosity obtained by spinning each individual polymer alone under the same spinning conditions as those of the conjugate fiber and by measuring with respect to the thus obtained individual yarn was defined as the intrinsic viscosity of fiber as a constituent of the conjugate fiber.

(2) Number of Crimps and Degree of Crimp

These were measured in accordance with the method of measuring a number of crimps and the method of measuring a degree of crimp as specified in JIS-L-1015 (method of testing a chemical fiber staple).

(3) Process Passability (Spinnability)

100 kg of poly(trimethylene terephthalate) staple fibers were supplied in a spinning process, and the passability through a carding machine and the occurrence of end breakage during spinning step were evaluated.

With respect to the passability through a carding machine, fibers were processed through a carding machine (flat carding machine in the cotton spinning and synthetic fiber spinning processes, but a roller carding machine in the worsted spinning process) at a spinning delivery speed of 100 m/min, and the wrap on a cylinder, web dangling from a web collecting calender, sliver breakage, etc. were evaluated.

With respect to the end breakage during the spinning step, the number of end breakages having occurred during continuous production of 100 kg of spun yarn by means of one spinning machine (400 spindles) was counted, and the number of end breakages per hour per spinning machine was calculated for evaluation of the end breakage characteristics.

(4) Feeling, Deformation and Durability

A circular knit fabric was prepared from obtained spun yarn, cut, and made up into sports wears. A wearing test comprising repeating one-day wearing followed by customary laundering was performed for an extended period of 20 days by ten monitors. With respect to the feeling, deformation and durability, an organoleptic evaluation based on a tactile sense and a judgment based on visual inspection were conducted, thereby enabling a relative evaluation.

EXAMPLE 1

Poly(trimethylene terephthalate) of [η]=0.72 was spun at a spinning temperature of 265° C. and at a spinning speed of 1200 m/min, thereby obtaining an undrawn filament. This filament was drawn under such conditions that the hot roll temperature was 60° C., the hot plate temperature 140° C., the draw ratio 3 and the drawing speed 800 m/min, thereby obtaining a drawn filament of 84 dtex/36 f. The strength, elongation and elastic modulus of the drawn filament were 3.5 cN/dtex, 45% and 25.3 cN/dtex, respectively.

200 thus obtained drawn filaments were formed into a tow, and the finishing agent for filaments was removed therefrom in a scouring step. Thereafter, a finishing oil for spinning whose main component was lauryl phosphate potassium salt was applied thereto in an amount of 0.1% omf. The resultant tow was subjected to a steaming step wherein thermal treatment was performed at 110° C. and to a stuffer crimping performed at 95° C. with the use of a stuffer box, and thereafter cut into fibers of 51 mm length with the use of an EC cutter. Thus, poly(trimethylene terephthalate) staple fibers were obtained. The number of crimps and degree of crimp of obtained poly(trimethylene terephthalate) staple fibers were 11.9 per 25 mm and 12.3%, respectively.

The obtained poly(trimethylene terephthalate) staple fibers were supplied in a spinning process according to the common synthetic fiber spinning system wherein a spun yarn was produced from the staple fibers by means of a ring spinning machine. For the spun yarn, twist setting was performed with the use of a vacuum setting machine at 80° C. for 15 min. With respect to the thus obtained spun yarn, the count in terms of metric count was 1/51.5 Nm (194.2 dtex), the twist multiplier α 95.3 (twist 684 T/m), the U % 14.7%, and the L-coefficient 1.61 (number of constituent fibers: 84.4).

The obtained spun yarn was reeled into a hank, and a hank dyeing was performed with the use of a bulky spray type dyeing machine at atmospheric pressure. The dyed spun yarn was formed into a circular plain knit fabric with the use of a 30 inch (76.2 cm) and 18 gauge circular knitting machine.

With respect to the spun yarn after dyeing, the tenacity (strength), elongation, initial stretching resistance, elastic recovery percentage of elongation at 5% elongation and other measurement and evaluation results are collectively listed in Table 1.

EXAMPLE 2

A spun yarn was produced in the same manner as in Example 1 except that blend spinning of 67 wt % of poly(trimethylene terephthalate) staple fibers employed in Example 1 and 33 wt % of cupra (Bemberg: trade name of Asahi Kasei Corporation) staple fibers (1.4 dtex fineness and 51 mm fiber length) was performed in the drawing step, and that the twist setting was performed at 60° C. for 15 min.

Thereafter, dyeing and formation of a circular knit fabric were carried out in the same manner as in Example 1. With respect to the spun yarn after dyeing, the properties and other measurement and evaluation results are collectively listed in Table 1.

EXAMPLE 3

A spun yarn was produced in the same manner as in Example 1 except that blend spinning of 33 wt % of poly(trimethylene terephthalate) staple fibers employed in Example 1 and 67 wt % of wool of quality 70 (average fineness: 4.0 dtex, and cut into 51 mm fiber length) was performed in the drawing step, and that the twist setting was performed at 70° C. for 15 min. Thereafter, dyeing and formation of a circular knit fabric were carried out in the same manner as in Example 1.

With respect to the spun yarn after dyeing, the properties and other measurement and evaluation results are collectively listed in Table 1.

EXAMPLE 4

Poly(trimethylene terephthalate) staple fibers of 1.7 dtex single-fiber fineness and 38 mm fiber length were produced in the same manner as in Example 1. The number of crimps and degree of crimp of obtained poly(trimethylene terephthalate) staple fibers were 16.4 per 25 mm and 15.8%, respectively.

Sliver blend spinning of 50 wt % of obtained poly (trimethylene terephthalate) staple fibers and 50 wt % of combed cotton was carried out in a drawing step, and a spun yarn was produced by a spinning process according to the common cotton spinning system. Thereafter, dyeing and formation of a circular knit fabric were carried out in the same manner as in Example 1.

With respect to the spun yarn after dyeing, the properties and other measurement and evaluation results are collectively listed in Table 1.

Comparative Example 1

A spun yarn was produced in the same manner as in Example 1 except that poly(ethylene terephthalate) staple fibers of 2.3 dtex fineness and 51 mm fiber length were employed. Thereafter, dyeing and formation of a circular knit fabric were carried out in the same manner as in Example 1.

With respect to the spun yarn after dyeing, the properties and other measurement and evaluation results are collectively listed in Table 1.

Comparative Example 2

A spun yarn was produced in the same manner as in Example 1 except that blend spinning of 67 wt % of poly(ethylene terephthalate) staple fibers employed in Comparative Example 1 and 33 wt % of cupra staple fibers (1.4 dtex fineness and 51 mm fiber length) was performed. In the same manner as in Example 1, except that the twist setting was performed at 60° C. for 15 min, dyeing and formation of a circular knit fabric were carried out.

With respect to the spun yarn after dyeing, the properties and other measurement and evaluation results are collectively listed in Table 1.

All the spun yarns of Examples 1 to 4 exhibited high elongation, so that the knitting performance thereof was strikingly excellent. Further, the initial stretching resistance was slight while the elongation was high, so that such a property of a fabric, that high elongation was attained with low stress, was obtained. Thus, the fabrics exhibited excellent stretchability. Still further, the elastic recovery percentage of elongation of the spun yarns was high, so that the knit fabrics thereof were excellent in stretch-back property.

The knit fabrics of Examples 2, 3 and 4 were those wherein without excess surfacing of the feeling of poly (trimethylene terephthalate) fiber, the feeling of cupra, wool and cotton as the other material in the blend was satisfactorily exhibited.

Wearing test results showed that with respect to the fabrics of Examples 1 to 4, the changes of feeling and dimension were extremely slight, and holing, surface worn-out blemish, pilling, etc. did not occur, whereby the fabric showed excellent durability.

In Comparative Example 1, the initial stretching resistance of the spun yarn was high while the elastic recovery percentage of elongation thereof was low, so that the knit fabric thereof exhibited hard feeling, poor stretchability and poor stretch-back property.

In Comparative Example 2, the elongation of the spun yarn was low, so that yarn breakage occurred at the time of knitting, thereby attesting to relatively poor knittability. Further, the initial stretching resistance of the spun yarn was high, while the elongation and elastic recovery percentage of elongation thereof were low, so that both the stretchability and stretch-back property of the knit fabric were poor. Still further, the tenacity and elongation product of the spun yarn was low, so that at the wearing test, surface worn-out blemish and pilling occurred, thereby attesting to poor durability.

EXAMPLES 5 to 9

The procedure of Example 1 was repeated except that the conditions of stuffer crimping with the use of a stuffer box were changed, thereby obtaining poly(trimethylene terephthalate) staple fibers differing in the number of crimps and the degree of crimp. Spun yarns were produced from the obtained poly(trimethylene terephthalate) staple fibers in the same manner as in Example 1. Thereafter, dyeing and formation of a circular knit fabric were carried out in the same manner as in Example 1.

With respect to the spun yarns after dyeing, the properties and other measurement and evaluation results are collectively listed in Table 2.

All the spun yarns of Examples 5 to 9 exhibited excellent knittability, and the obtained knit fabrics were excellent in stretchability and stretch-back property. In the wearing test thereof, the changes of feeling and dimension were extremely slight, and holing, surface worn-out blemish, pilling, etc. did not occur, thereby attesting to excellent durability.

Such tendencies that the nep and slub of spun yarn were slightly increased, the L-coefficient was also increased, and the uniformity of spun yarn was lowered in accordance with an increase of the number of crimps and degree of crimp were recognized. In particular, in Example 5, both the number of crimps and the degree of crimp were considerably large, so that the openability of fibers was slightly unsatisfactory, the occurrence of end breakage in the spinning step was slightly high, and a yarn whose L-coefficient exceeded 2.0 attesting to slightly poor uniformity resulted. In Example 9, both the number of crimps and the degree of crimp were considerably small, so that the tendency of web dangling at a web collecting calender zone was recognized in the carding step.

EXAMPLES 10 to 14

Bias-cut poly(trimethylene terephthalate) staple fibers of 2.2 dtex fineness and 64 to 89 mm fiber length were produced in the same manner as in Example 1. However, the conditions of stuffer crimping with the use of a stuffer box were changed, thereby obtaining poly(trimethylene terephthalate) staple fibers differing in the number of crimps and the degree of crimp.

Individual poly(trimethylene terephthalate) staple fibers obtained were supplied in a worsted spinning process. Blend spinning of 30 wt % of poly(trimethylene terephthalate) staple fibers and 70 wt % of wool of quality 70 (average fineness: 4.0 dtex) was performed in a mixing gill step, and formation of a spun yarn was carried out by means of a ring spinning machine.

Each of the obtained spun yarns was dyed and formed into a circular knit fabric in the same manner as in Example 1 except that the twist setting was performed at 70° C. for 15 min.

With respect to the spun yarns after dyeing, the properties and other measurement and evaluation results are collectively listed in Table 3.

All the spun yarns of Examples 10 to 14 exhibited excellent knittability, and the obtained knit fabrics were not only excellent in stretchability and stretch-back property but also found to be those satisfactorily making the most of the feeling of wool. In the wearing test thereof, the changes of feeling and dimension were extremely slight, and holing, surface worn-out blemish, pilling, etc. did not occur, thereby attesting to excellent durability.

However, as experienced in the above Examples 5 to 9, such tendencies that the nep and slub of spun yarn were slightly increased, the L-coefficient was also increased, and the uniformity of spun yarn was lowered in accordance with an increase of the number of crimps and degree of crimp were recognized. In particular, in Example 10, both the number of crimps and the degree of crimp were considerably large, so that the openability of fibers was slightly unsatisfactory, the occurrence of end breakage in the spinning step was slightly high, and a yarn whose L-coefficient exceeded 2.0 attesting to slightly poor uniformity resulted. In Example 14, both the number of crimps and the degree of crimp were considerably small, so that the tendency of web dangling at a web collecting calender zone was recognized in the carding step.

EXAMPLES 15 to 18

Poly(trimethylene terephthalate) staple fibers were produced in the same manner as in Example 1 except that the ratio of adhesion of the finishing oil for spinning whose main component was lauryl phosphate potassium salt was changed. The obtained poly(trimethylene terephthalate) staple fibers were formed into a spun yarn, dyed and formed into a circular knit fabric in the same manner as in Example 1.

With respect to the spun yarns after dyeing, the properties and other measurement and evaluation results are collectively listed in Table 4.

All the spun yarns of Examples 15 to 18 exhibited excellent knittability, and the obtained knit fabrics were excellent in stretchability and stretch-back property. In the wearing test thereof, the changes of feeling and dimension were extremely slight, and holing, surface worn-out blemish, pilling, etc. did not occur, thereby attesting to excellent durability.

In Example 16, the ratio of adhesion of finishing oil was appropriate, so that the passability through carding machine was excellent and the occurrence of end breakage in the spinning step was very low, thereby attesting to extremely high spinnability. Further, the L-coefficient thereof was small, thereby attesting to excellent uniformity of yarn.

In Example 15, the amount of adhering finishing oil was slightly small, so that the generation of static electricity in the carding step and the spinning step was slightly high. In the spinning step, the occurrence of end breakage attributed to the wrap on a bottom roller was slightly large. Further, the L-coefficient thereof exceeded 2.0, attesting to slightly poor uniformity.

In Example 17, the amount of adhering finishing oil was slightly in excess, so that the occurrence of end breakage attributed to the wrap of staple fibers on a top roller was slightly high in the spinning step. However, the uniformity of yarn was tolerable.

In Example 18, the amount of adhering finishing oil was in excess, so that not only was the tendency to wrap on a cylinder recognized in the carding step but also the occurrence of end breakage was slightly increased in the spinning step. The L-coefficient thereof exceeded 2.0, attesting to rather unsatisfactory uniformity.

EXAMPLE 19

Poly(trimethylene terephthalate) staple fibers were produced in the same manner as in Example 1 except that the finishing agent for filament whose main components were a fatty acid ester and a polyether of 1,500 molecular weight was not removed and that the finishing oil for spinning was not applied. The ratio of adhesion of finishing agent was 0.12% omf.

The obtained poly(trimethylene terephthalate) staple fibers were formed into a spun yarn, dyed and formed into a circular knit fabric in the same manner as in Example 1.

With respect to the spun yarns after dyeing, the properties and other measurement and evaluation results are collectively listed in Table 4.

The obtained spun yarn exhibited satisfactory knittability, and the obtained knit fabric was excellent in stretchability and stretch-back property. In the wearing test thereof, satisfactory results were attained.

However, the finishing oil was not most appropriate, so that the generation of static electricity in the carding step and the spinning step was slightly high. In particular, the occurrence of end breakage in the spinning step was slightly high. Further, the L-coefficient thereof exceeded 2.0, attesting to slightly poor uniformity.

EXAMPLE 20

Two types of poly(trimethylene terephthalate) polymers having different intrinsic viscosity values used at a ratio of 1:1 were extruded into an eccentric sheath core form (high viscosity polymer constituting the core) so as to obtain an undrawn filament at a spinning temperature of 265° C. and at a spinning speed of 1500 m/min. This filament was drawn and twisted under such conditions that the hot roll temperature was 55° C., the hot plate temperature 140° C. and the drawing speed 400 m/min. With respect to the draw ratio, it was so set that the fineness after drawing was 84 dtex. Thus, a 84 dtex/36 f eccentric sheath core type conjugate multifilament was obtained. With respect to the obtained conjugate multifilament, the intrinsic viscosity [η] of the high viscosity side was 0.90 while the intrinsic viscosity [η] of the low viscosity side was 0.70.

Poly(trimethylene terephthalate) staple fibers of 51 mm fiber length were produced from the obtained conjugate multifilament in the same manner as in Example 1 except that the stuffer crimping with the use of a stuffer box was not effected. The number of crimps and degree of crimp of obtained poly(trimethylene terephthalate) staple fibers were 13.2 per 25 mm and 17.5%, respectively.

The obtained poly(trimethylene terephthalate) staple fibers were formed into a spun yarn, dyed and formed into a circular knit fabric in the same manner as in Example 1.

With respect to the spun yarns after dyeing, the properties and other measurement and evaluation results are collectively listed in Table 4.

The obtained spun yarn exhibited satisfactory knittability, and the obtained knit fabric was excellent in stretchability and stretch-back property. In the wearing test thereof, satisfactory results were attained.

TABLE 1

| | Example 1 | Example 2 | | Example 3 | | Example 4 | | Comp. Ex. 1 | Comp. Ex. 2 | |
|---|---|---|---|---|---|---|---|---|---|---|
| Staple fiber | | | | | | | | | | |
| Fiber | PTT | PTT | Bem | PTT | Wool | PTT | Cotton | PET | PET | Bem |
| Content (%) | 100 | 67 | 33 | 33 | 67 | 50 | 50 | 100 | 67 | 33 |
| Single fiber size (dtex) | 2.3 | 2.3 | 1.4 | 2.3 | 4.0 | 1.7 | 2.1 | 2.3 | 2.3 | 1.4 |
| Fiber length (mm) | 51 | 51 | 51 | 51 | 51 | 38 | 30 | 51 | 51 | 51 |
| Number of crimps (per 25 mm) | 11.9 | 11.9 | 12.2 | 11.9 | — | 16.4 | — | 13.2 | 13.2 | 12.2 |
| Degree of crimp (%) | 12.3 | 12.3 | 15.1 | 12.3 | — | 15.8 | — | 14.5 | 14.5 | 15.1 |
| Spinnability | | | | | | | | | | |
| Passability through carding machine | Good | Good | | Good | | Good | | Good | Good | |
| Spinning end breakage (No./frame-hour) | 4.2 | 6.7 | | 7.2 | | 5.3 | | 5.3 | 6.4 | |
| Spun yarn | | | | | | | | | | |
| Count (Nm) | 1/51.5 | 1/51.7 | | 1/52.5 | | 1/52.3 | | 1/52.4 | 1/52.0 | |
| Fineness (dtex) | 194.2 | 193.4 | | 190.5 | | 191.2 | | 190.8 | 192.3 | |
| Twist multiplier | 95.3 | 95.9 | | 100.8 | | 104.7 | | 94.2 | 95.3 | |
| Number of constituent fibers | 84.4 | 101.9 | | 59.2 | | 101.8 | | 83.0 | 101.3 | |
| U% (%) | 14.7 | 12.1 | | 17.3 | | 13.3 | | 14.9 | 12.5 | |
| I (L) coefficient | 1.61 | 1.41 | | 1.66 | | 1.55 | | 1.62 | 1.46 | |
| Spun yarn after dyeing | | | | | | | | | | |
| Tenacity (cN/dtex) | 1.52 | 1.09 | | 0.81 | | 2.03 | | 3.89 | 1.62 | |
| Elongation (%) | 43.9 | 26.8 | | 27.6 | | 18.6 | | 14.5 | 8.6 | |
| Tenacity and elongation product (cN · % /dtex) | 66.7 | 29.2 | | 22.4 | | 37.8 | | 56.4 | 13.9 | |
| Initial stretching resistance (cN/dtex) | 6.7 | 9.6 | | 7.5 | | 12.4 | | 37.9 | 36.6 | |
| Elastic recovery percentage of elongation at 5% elongation (%) | 91.4 | 88.1 | | 85.5 | | 87.3 | | 72.2 | 68.0 | |

TABLE 2

| | Example 5 | Example 6 | Example 7 | Example 8 | Example 9 |
|---|---|---|---|---|---|
| Staple fiber | | | | | |
| Fiber | PTT | PTT | PTT | PTT | PTT |
| Content (%) | 100 | 100 | 100 | 100 | 100 |
| Single fiber size (dtex) | 2.3 | 2.3 | 2.3 | 2.3 | 2.3 |
| Fiber length (mm) | 51 | 51 | 51 | 51 | 51 |
| Number of crimps (per 25 mm) | 16.8 | 14.5 | 12.3 | 10.8 | 9.7 |
| Degree of crimp (%) | 25.2 | 15.6 | 19.7 | 13.2 | 11.5 |
| Spinnability | | | | | |
| Passability through carding machine | Good | Good | Good | Good | Rather poor |
| Spinning end breakage (No./frame · hour) | 12.8 | 5.3 | 6.1 | 5.5 | 4.7 |

TABLE 2-continued

| | Example 5 | Example 6 | Example 7 | Example 8 | Example 9 |
|---|---|---|---|---|---|
| Spun yarn | | | | | |
| Count (Nm) | 1/52.7 | 1/52.3 | 1/52.0 | 1/51.8 | 1.52.1 |
| Fineness (dtex) | 189.8 | 191.2 | 192.3 | 193.1 | 191.9 |
| Twist multiplier | 95.2 | 95.1 | 95.3 | 94.9 | 94.8 |
| Number of constituent fibers | 82.5 | 83.1 | 83.6 | 84.0 | 83.4 |
| U % (%) | 19.3 | 18.1 | 16.8 | 14.2 | 15.6 |
| I (L) coefficient | 2.10 | 1.97 | 1.84 | 1.55 | 1.70 |
| Spun yarn after dyeing | | | | | |
| Tenacity (cN/dtex) | 1.28 | 1.36 | 1.32 | 1.50 | 1.62 |
| Elongation (%) | 40.3 | 42.9 | 41.8 | 44.7 | 43.1 |
| Tenacity and elongation product (cN · % /dtex) | 51.6 | 58.3 | 55.2 | 67.1 | 69.8 |
| Initial stretching resistance (cN/dtex) | 7.5 | 7.2 | 7.6 | 6.5 | 6.9 |
| Elastic recovery percentage of elongation at 5% elongation (%) | 88.6 | 89.5 | 92.2 | 87.0 | 88.7 |

TABLE 3

| | Example 10 | | Example 11 | | Example 12 | | Example 13 | | Example 14 | |
|---|---|---|---|---|---|---|---|---|---|---|
| Staple fiber | | | | | | | | | | |
| Fiber | PTT | Wool | PTT | Wool | PTT | Wool | PTT | Wool | PTT | Wool |
| Content (%) | 30 | 70 | 30 | 70 | 30 | 70 | 30 | 70 | 30 | 70 |
| Single fiber size (dtex) | 2.2 | 4.0 | 2.2 | 4.0 | 2.2 | 4.0 | 2.2 | 4.0 | 2.2 | 4.0 |
| Fiber length (mm) | 64–89 Bias | — | 64–89 Bias | — | 64–89 Bias | — | 64–89 Bias | — | 64–89 Bias | — |
| Number of crimps (per 25 mm) | 12.3 | — | 11.8 | — | 10.7 | — | 9.8 | — | 6.2 | — |
| Degree of crimp (%) | 20.5 | — | 15.2 | — | 14.1 | — | 12.4 | — | 10.3 | — |
| Spinnability | | | | | | | | | | |
| Passability through carding machine | Good | | Good | | Good | | Good | | Rather poor | |
| Spinning end breakage (No./frame · hour) | 11.3 | | 6.5 | | 5.3 | | 7.1 | | 7.5 | |
| Spun yarn | | | | | | | | | | |
| Count (Nm) | 1/48.5 | | 1/47.8 | | 1/48.0 | | 1/48.3 | | 1/47.5 | |
| Fineness (dtex) | 206.2 | | 209.2 | | 208.3 | | 207.0 | | 210.5 | |
| Twist multiplier | 82.2 | | 83.2 | | 82.4 | | 82.0 | | 82.6 | |
| Number of constituent fibers | 64.2 | | 65.1 | | 64.9 | | 64.5 | | 65.5 | |
| U% (%) | 20.3 | | 18.9 | | 17.6 | | 16.3 | | 17.0 | |
| I (L) coefficient | 2.03 | | 1.90 | | 1.77 | | 1.63 | | 1.71 | |
| Spun yarn after dyeing | | | | | | | | | | |
| Tenacity (cN/dtex) | 0.73 | | 0.75 | | 0.82 | | 0.78 | | 0.76 | |
| Elongation (%) | 24.7 | | 25.4 | | 24.6 | | 26.7 | | 27.8 | |
| Tenacity and elongation product (cN · %/ dtex) | 18.0 | | 19.1 | | 20.2 | | 20.8 | | 21.1 | |
| Initial stretching resistance (cN · %/ dtex) | 12.9 | | 13.2 | | 12.8 | | 12.7 | | 12.5 | |
| Elastic recovery percentage of elongation at 5% elongation (%) | 80.8 | | 80.3 | | 79.2 | | 78.8 | | 81.2 | |

TABLE 4

| | Example 15 | Example 16 | Example 17 | Example 18 | Example 19 | Example 20 |
|---|---|---|---|---|---|---|
| Staple fiber | | | | | | |
| Fiber | PTT | PTT | PTT | PTT | PTT | PTT/PTT |
| Content (%) | 100 | 100 | 100 | 100 | 100 | 100 |
| Single fiber size (dtex) | 2.3 | 2.3 | 2.3 | 2.3 | 2.3 | 2.3 |
| Fiber length (mm) | 51 | 51 | 51 | 51 | 51 | 51 |
| Number of crimps (per 25 mm) | 11.9 | 11.9 | 11.9 | 11.9 | 11.9 | 13.2 |

TABLE 4-continued

| | Example 15 | Example 16 | Example 17 | Example 18 | Example 19 | Example 20 |
|---|---|---|---|---|---|---|
| Degree of crimp (%) | 12.3 | 12.3 | 12.3 | 12.3 | 12.3 | 17.5 |
| Amt. of adhering finishing oil (% omf) | 0.03 | 0.15 | 0.35 | 0.55 | 0.12 | 0.10 |
| Spinnability | | | | | | |
| Passability through carding machine | Rather poor | Good | Good | Rather poor | Rather poor | Good |
| Spinning end breakage (No./frame-hour) | 23.8 | 5.3 | 13.6 | 28.9 | 28.8 | 8.4 |
| Spun yarn | | | | | | |
| Count (Nm) | 1/52.1 | 1/51.8 | 1/52.4 | 1/51.9 | 1/52.3 | 1/52.2 |
| Fineness (dtex) | 191.9 | 193.1 | 190.8 | 192.7 | 191.2 | 191.6 |
| Twist multiplier | 95.2 | 95.3 | 94.8 | 94.9 | 95.1 | 95.0 |
| Number of constituent fibers | 83.5 | 83.9 | 83.0 | 83.8 | 83.1 | 83.3 |
| U% (%) | 18.6 | 14.3 | 16.2 | 18.8 | 19.5 | 13.7 |
| I (L) coefficient | 2.03 | 1.57 | 1.77 | 2.06 | 2.13 | 1.50 |
| Spun yarn after dyeing | | | | | | |
| Tenacity (cN/dtex) | 1.38 | 1.54 | 1.51 | 1.40 | 1.52 | 1.48 |
| Elongation (%) | 40.2 | 42.8 | 41.5 | 39.1 | 41.8 | 39.5 |
| Tenacity and elongation product (cN · %/dtex) | 55.5 | 65.9 | 62.7 | 54.7 | 63.5 | 58.5 |
| Initial stretching resistance (cN/dtex) | 7.0 | 6.6 | 6.8 | 6.9 | 6.7 | 6.2 |
| Elastic recovery percentage of elongation at 5% elongation (%) | 91.7 | 90.6 | 89.2 | 92.1 | 91.3 | 90.4 |

The abbreviations and expression for fibers employed in the tables have the following meanings:

PTT: poly(trimethylene terephthalate),

PET: poly(ethylene terephthalate),

Bem: Bemberg (trade name for cupra fiber produced by Asahi Kasei Corporation), and Wool: wool.

Industrial Applicability

The spun yarn of the present invention is excellent in knitting and weaving characteristics. The woven and knit fabrics therefrom are excellent in stretchability and stretch-back property, and further excellent in shape stability and durability when worn for a prolonged period of time. The composite spun yarn of poly(trimethylene terephthalate) staple fibers and other fibers exerts excellent functions with respect to stretchability, stretch-back property, shape stability, etc., while satisfactorily making the most of the feeling of other material blended.

The spun yarn of the present invention is useful for jersey cloths such as tights, socks and sportswear, a covering yarn for an elastic yarn, outer woven and knit fabrics, clothing such as underwear, towel, bath mat, interior fabric such as carpet, bedding and the like.

What is claimed is:

1. A spun yarn comprising poly(trimethylene terephthalate) staple fibers at a content of at least 15% by weight, said spun yarn having an elastic recovery percentage of elongation at 5% elongation satisfying the formula:

$$\text{elastic recovery percentage of elongation at 5\% elongation (\%)} \geqq 0.1\,X+70 \quad \text{(a)}$$

wherein X represents the content of poly(trimethylene terephthalate) staple fibers in the spun yarn (% by weight).

2. The spun yarn according to claim 1, which is a composite spun yarn comprising poly(trimethylene terephthalate) staple fibers and other fibers, wherein the content of poly(trimethylene terephthalate) staple fibers is in the range of 15 to 70% by weight.

3. The spun yarn according to claim 1 or 2, which exhibits an elongation at break of 10% or greater.

4. The spun yarn according to claim 1 or 2, which exhibits a tenacity and elongation product of 15 cN.%/dtex or greater.

5. The spun yarn according to claim 1 or 2, which exhibits an I-coefficient or L-coefficient of 1.0 to 2.5.

6. The spun yarn according to claim 1 or 2, to which a finishing oil has been applied, said finishing oil containing an alkyl phosphate salt whose alkyl group has 8 to 18 carbon atoms on the average.

* * * * *